US006215736B1

(12) United States Patent
Terzian

(10) Patent No.: US 6,215,736 B1
(45) Date of Patent: Apr. 10, 2001

(54) ENHANCED QUADRIBALANCED DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 09/619,368

(22) Filed: Jul. 19, 2000

Related U.S. Application Data

(63) Continuation-in-part of application No. 09/482,479, filed on Jan. 12, 2000, now abandoned.

(51) Int. Cl.[7] ..... G04C 19/00
(52) U.S. Cl. ..... 368/82; 368/239
(58) Field of Search ..... 368/107–113, 82–84, 368/239–240, 223

(56) References Cited

U.S. PATENT DOCUMENTS 4,194,352 * 3/1980 Terzian ..... 368/239
4,264,966 * 4/1981 Terzian ..... 368/82
4,270,196 * 5/1981 Terzian ..... 368/82
4,271,497 * 6/1981 Terzian ..... 368/82
4,483,628 11/1984 Terzian .
4,627,737 * 12/1986 Nance et al. ..... 368/239
4,671,673 * 6/1987 Terzian ..... 368/82
4,720,823 * 1/1988 Terzian ..... 368/190
5,182,733 * 1/1993 Terzian ..... 368/82
5,757,730 5/1998 Terzian .
5,805,534 9/1998 Terzian .

* cited by examiner

*Primary Examiner*—Bernard Roskoski
(74) *Attorney, Agent, or Firm*—Lucas & Just

(57) ABSTRACT

Quadribalanced digital time displays and methods comprising increasing digital minutes displayed on the right flank of centrally positioned digital present hours, in relatively upper and lower positions during the first and second quarter hours, followed by decreasing digital minutes displayed on the left flank of digital next hours, in relatively lower and upper positions during the third and fourth quarter hours, are enhanced by simultaneously displaying markers in one or more of the three quarter hour minute positions not containing digital minutes at any one time to inform the viewer that such marked positions are functional elements of the display but not activated due to the current time being displayed in another of said minute positions at that time.

40 Claims, 11 Drawing Sheets

ENHANCED QUADRIBALANCED DIGITAL TIME DISPLAYS

This application is a continuation-in part of application Ser. No. 09/482,479, filed Jan. 12, 2000 now abandoned.

BACKGROUND OF THE INVENTION

I. Field of the Invention

This invention relates to timekeeping and, more particularly, to the use of digital time displays for general purpose timekeeping, as most individuals typically undertake in going about their daily activities while watching and keeping track of the time.

II. Description of the Prior Art

Quadribalanced digital time displays are described in U.S. Pat. No. 4,271,497, the disclosure of which is incorporated herein by reference. Those displays comprise centrally positioned current hour digits flanked on the right by increasing minute digits which are displayed in upper and lower positions relative to the hour digits during the first and second quarter hours. Thereafter, incremented next hour digits are flanked on the left by decreasing minute digits which are displayed in lower and upper positions relative to the hour digits during the third and fourth quarter hours. In this way the four quarter hours are precisely defined, balanced and visually differentiated, while elapsed and future time are viewed during the respective first and second halves of each hour.

III. Recognition of Problems in the Prior Art

It has now been discovered that the previous quadribalanced displays have certain characteristics which are not the most desirable . In particular, as the respective quarter hours are display ed from the first through the fourth, the corresponding minute displays occupy only a limited portion of the total space surrounding the centrally positioned hours. Throughout the hour, most of this space remains completely empty, thus giving some viewers a sense of incompleteness and a contradictory or incorrect suggestion that these spaces are not functional in the overall display, at least while they remain blank.

By way of contrast and example, most conventional dial watches and clocks are not characterized in the same way. They usually have from four to twelve hour digits, with or without intermediate minute hash marks, positioned around the periphery of the dial, thereby making the viewer visually conscious of the fact that the entire area swept around the dial by the hour and minute hands has a role in defining the time at one time or another during the course of an hour. The lack of similar symbolism and effects in the quadribalanced displays of U.S. Pat. No. 4,271,497 potentially detracts from their utility and appeal to consumers.

SUMMARY OF THE INVENTION

The present invention significantly improves the conventional quadribalanced displays discussed above. In the enhanced quadribalanced displays of the present invention, one or more of the quarter hour positions not occupied by digital minutes at any one time is/are provided with markers which serve to inform the viewer that such positions are functional parts of the overall display but not activated because the current time is defined by digital minutes being displayed in another part of the display. In this way, the emptiness of most of the space around the centrally positioned digital hours is eliminated. Instead, preferably, all four of the respective quarter hour minute positions are controlled to contain active digital displays comprising digital minutes in each of the respective first to fourth quarters and, for purposes of both differentiation and completeness, markers in the respective other three quarter hour positions which remind the viewer that those spaces are functional although not then involved in defining the current time. The enhancement of the previously described quadribalanced displays in this manner provides considerable improvement in the appeal and utility of such systems for general purpose timekeeping.

Other features and details of the invention will be evident from the subsequent specific description, taken in connection with the drawings.

DESCRIPTION OF THE PREFERRED EMBODIMENT

Figure 1:
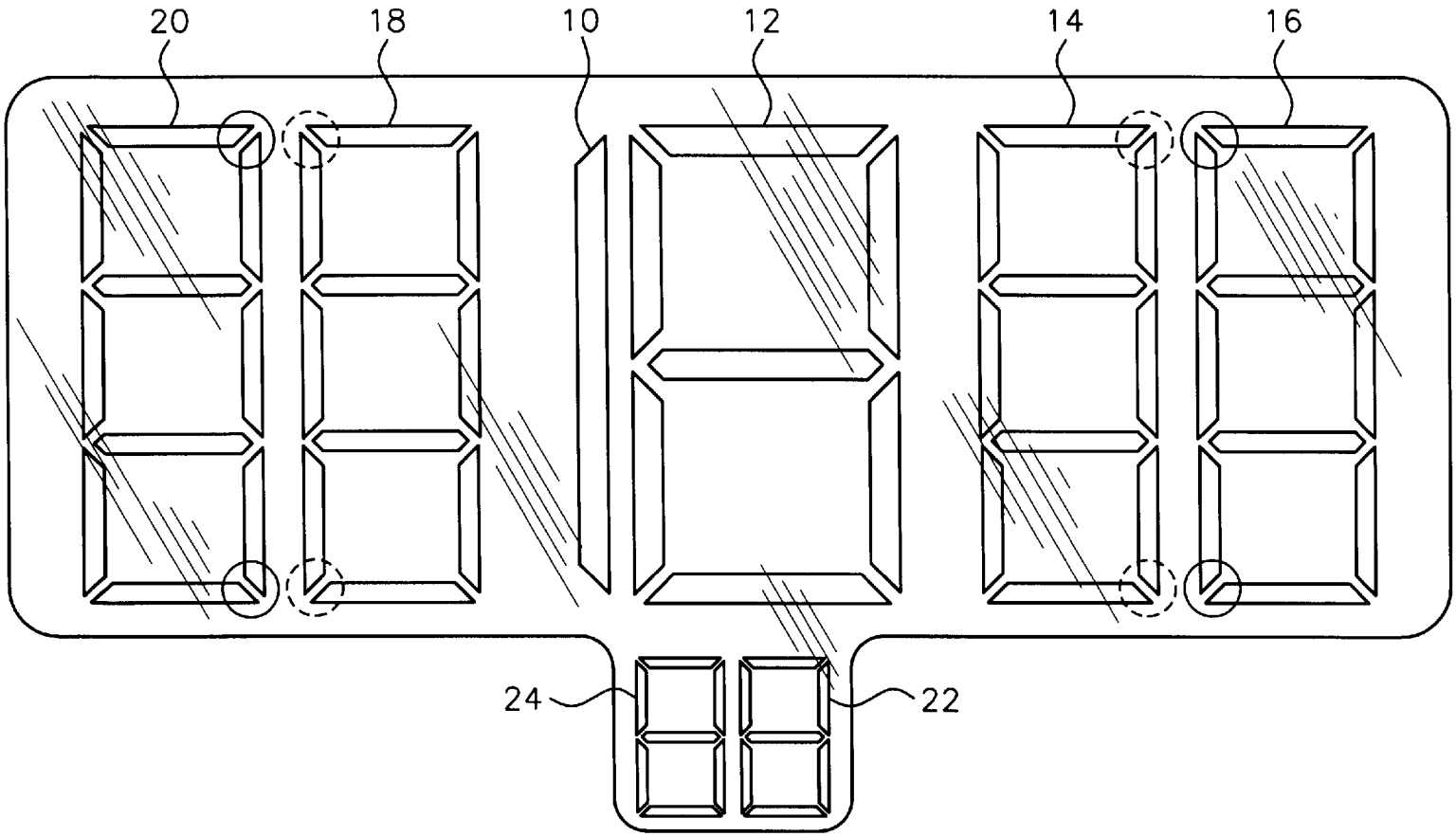
FIG. 1 (Prior Art)
FIG. 1 is a copy of FIG. 1 of U.S. Pat. No. 4,271,497 with added solid and dashed line circles around certain inboard corners of the digital minute elements (relative to the center of the display).

Referring now to FIG. 1, digital display elements 10, 12 are at the center of the display and activatable to show hours of values one to twelve, as previously explained in U.S. Pat. No. 4,271,497.

Flanking the hour elements 10, 12 on the right is a pair of 10-segmented digital display elements 14, 16 which are activatable to show increasing minutes of values zero to 30 during the first half hour, in relatively upper and lower positions generated by activating the uppermost 7 of the 10 segments during the first quarter hour and the lowermost 7 of the 10 segments during the second quarter hour, while the hour elements 10, 12 are displaying the current hour. Similarly, a second pair of 10-segmented digital display elements 18, 20 flanks the hour display elements 10, 12 on the left. This pair is activatable to show decreasing minutes of values 29 to zero during the second half hour, in relatively lower and upper positions generated by activating the lowermost 7 of the 10 segments during the third quarter hour and the uppermost 7 of the 10 segments during the fourth quarter hour, while the hour elements 10, 12 are displaying the next hour.

Finally, digital display elements 22, 24 are located below the centrally positioned hour elements 10, 12 and are activatable to show incrementing digital seconds of values 0 to 59 during each minute of the first half hour and decrementing digital seconds of values 59 to 0 during each minute of the second half hour.

The foregoing is a summary of the disclosure of U.S. Pat. No. 4,271,497, further details of which can be understood by reference to the patent document.

Figure 2:
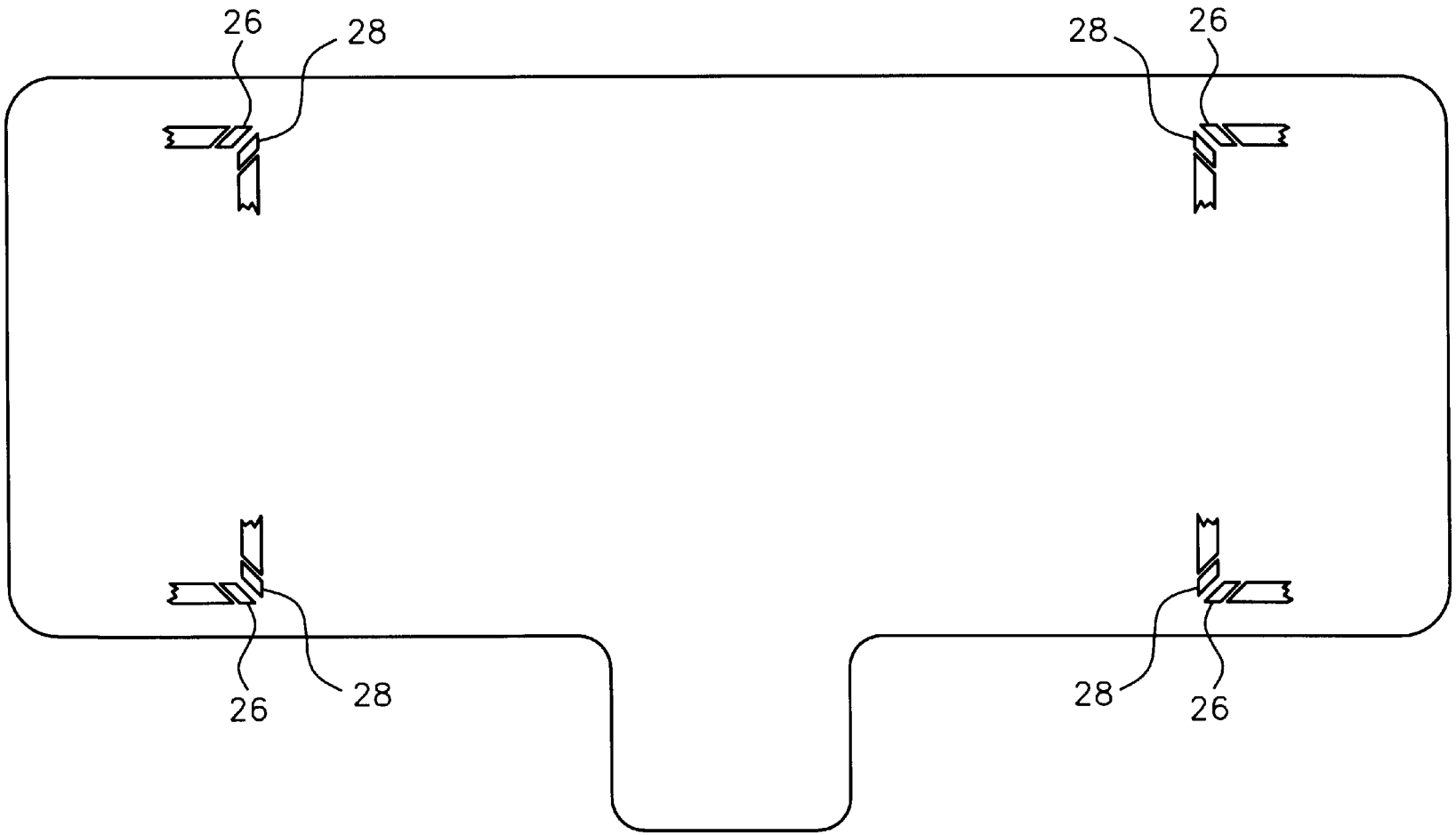
FIG. 2 is a view of the corners included within the solid line circles of FIG. 2 on a magnified scale to facilitate visualization and comprehension.

Referring again to the digital display elements 16 and 20 of FIG. 1, it will be seen that the uppermost and lowermost inboard corners thereof are enclosed within solid line circles. The reason for this will be understood by reference to FIG. 2 in which the same corners are shown on a magnified scale.

As illustrated, each corner includes the terminal ends of the two uppermost/lowermost horizontal and vertical elements most closely adjacent to each other on opposite sides of a very small 45° slanted gap analogous to a mitered joint. The same structure is shown in the analogous corners of the display elements 30*b* and 32*a* of FIG. 1 of U.S. Pat. No. 4,271,497. However, in FIG. 1 of this application, each of the above-referenced adjacent ends of the circled horizontal and vertical corner elements are severed and separated a second time from the remainder of the element, at the same 45° angle, to provide a pair of much smaller segments 26, 28 that can be separately activated to serve as markers, in accordance with the present invention.

Figure 3:
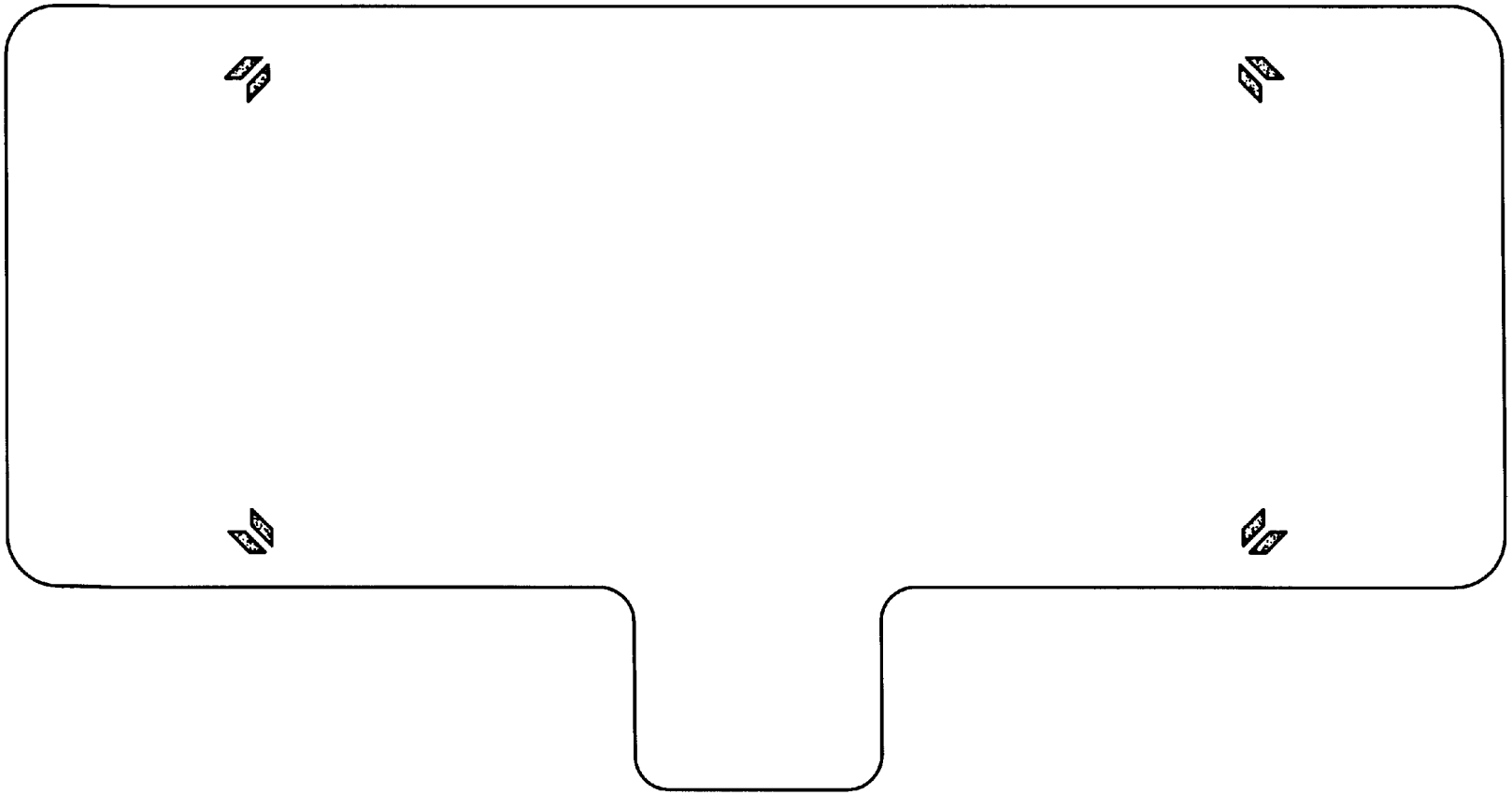
FIG. 3 is a view of the same circled corners reduced back to the scale of FIG. 1 and simultaneously activated to show the resulting markers that are used in accordance with an embodiment of the invention.

Such separate activation of all four pairs is portrayed in FIG. 3. As there seen, the severed display segments in the four corners form inclined double dashes, preferably at substantially 45° angles, and thus oriented in positions which tend to surround the central area occupied by the digital hour elements 10, 12. As a result, the viewer is given a sense of rotational motion by these markers, analogous to the sweep of the minute hand of a conventional dial watch, instead of the emptiness manifested in the display of the previously cited patent.

Figure 4:
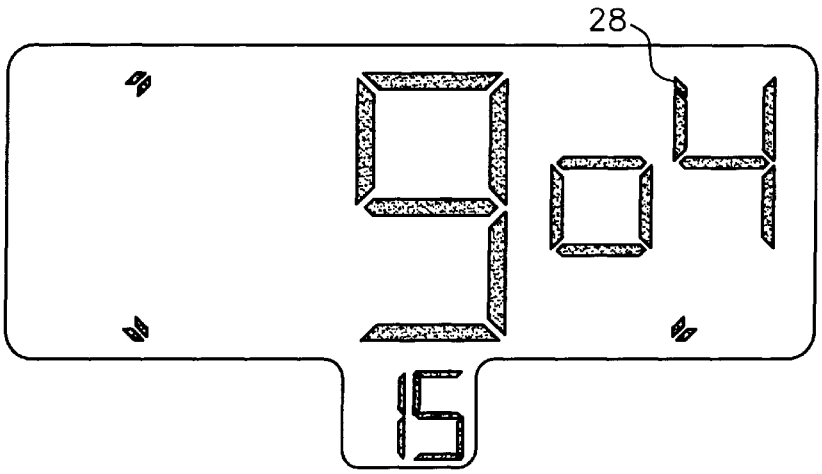
FIGS. 4–7 are views of representative time displays that are presented to the viewer during the four quarter hours in accordance with the embodiment of FIG. 3.

The resulting overall effects of differentiation and completeness are shown by the representative quarter hour time displays of FIGS. 4 through 7. In FIG. 4 the current time is four minutes and 15 seconds past nine during the first quarter hour, produced by selective activation of the corresponding elements of the hour, minute and seconds display elements in FIG. 1. In addition, the remaining three lowermost and uppermost inboard corner segments of the digital minute elements 16 and 20 have been simultaneously activated to form the three sets of inclined double dash markers at the tops and bottom of the spaces where the forthcoming current minutes of time will be displayed during the second through fourth quarters of the same hour.

It should be understood that the small marker segments 26, 28 will also be activated whenever necessary to display the full length of their particular elements as part of the digital minute value being displayed. Thus, in FIG. 4, vertical marker segment 28 is activated to provide the full length of the corresponding inboard vertical leg of the digital minute value 4.

Figure 5:
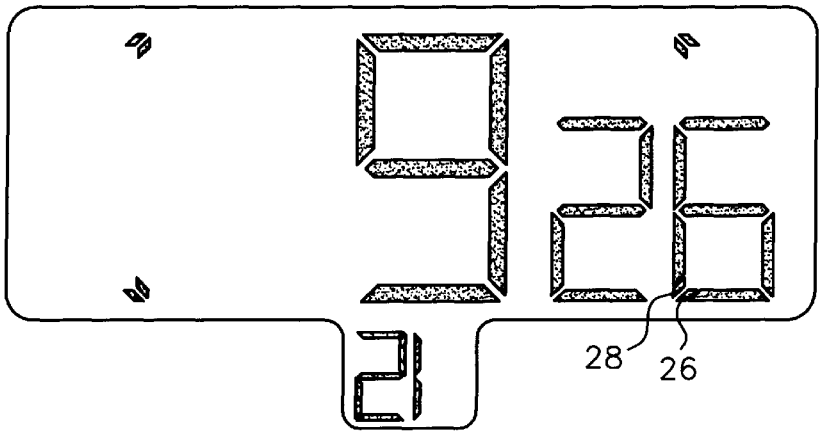

FIG. 5 displays a representative second quarter hour current time of twenty six minutes and twenty one seconds past the ninth hour, with the inclined double dash marks preferably simultaneously activated in the remaining three spaces where current minutes are normally shown during the first, third and fourth quarter hours. Both inboard marker segments 26, 28 are also activated to provide the full lengths of the corresponding lowermost horizontal and vertical legs of the digital minute value 6.

Figure 6:
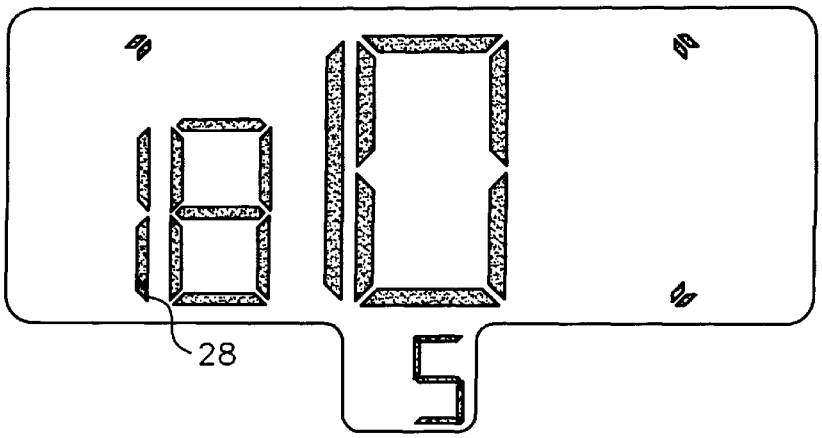

FIG. 6 displays a representative third quarter hour current time of eighteen minutes and five seconds before the tenth hour. Simultaneously, inclined double dash markers are preferably activated in the spaces where current minutes are normally shown during the first, second and fourth quarter hours. As in FIG. 4, the inboard vertical marker segment 28 is also simultaneously activated to provide the full length of the corresponding lowermost vertical leg of the digital minute value 1 in the tens of minutes position.

Figure 7:
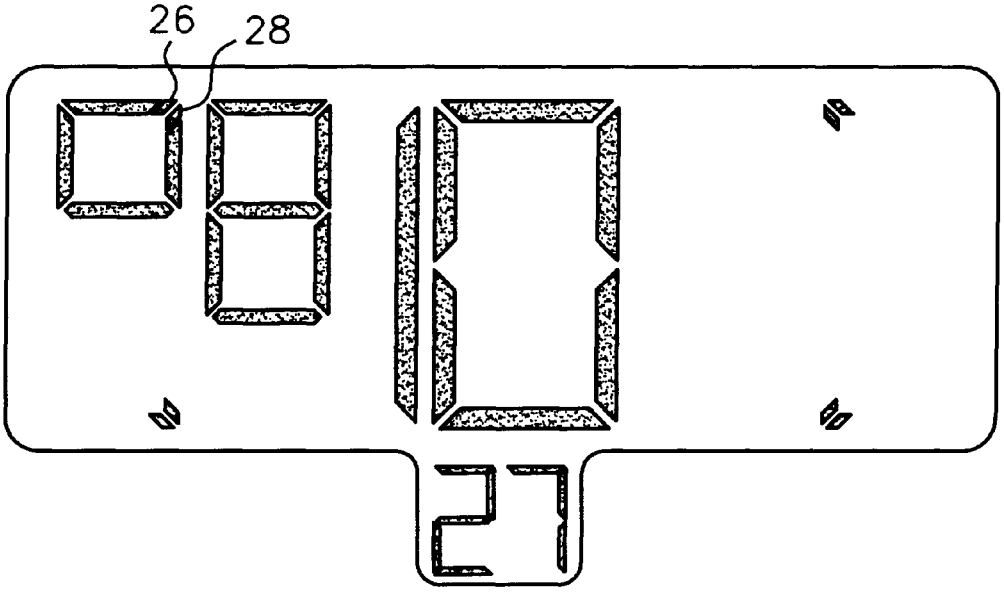

FIG. 7 completes the cycle by displaying a representative fourth quarter time of eight minutes and twenty seven seconds before the tenth hour. Simultaneously-activated inclined double dash markers preferably appear in the spaces where current minutes were earlier normally displayed during the previous three quarter hours. Also, both inboard marker segments 26, 28 are simultaneously activated to provide the full lengths of the corresponding horizontal and vertical legs of the digital minute value 0 in the tens of minutes position. Thus, by contributing differentiation and completeness of active and inactive quarter hour areas of the overall display, the newly marked displays exemplified in FIGS. 4–7 demonstrate the enhancement achieved by the present invention compared to the previous quadribalanced displays of U.S. Pat. No. 4,271,497.

Figure 8:
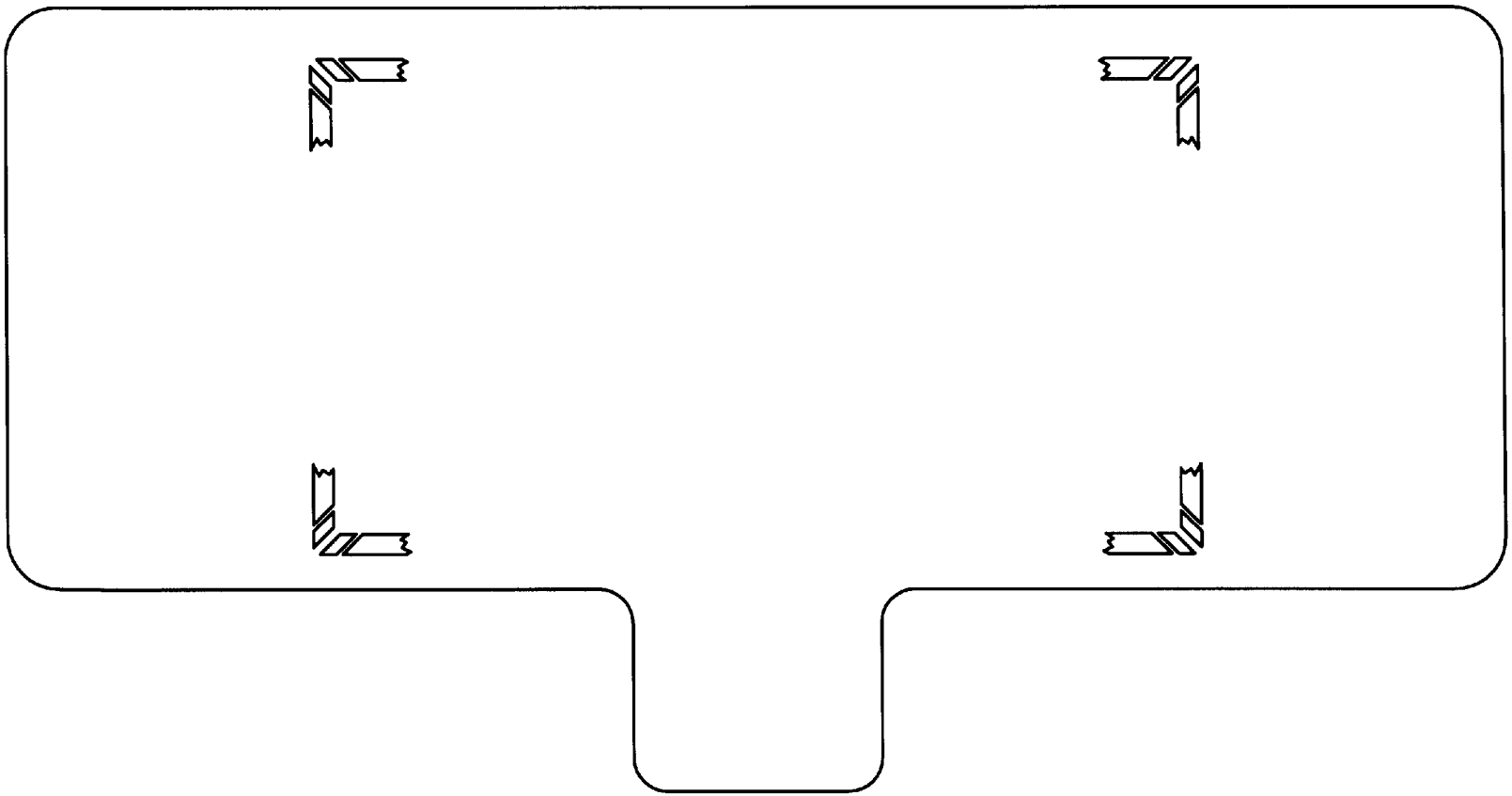
FIG. 8 is a view of the corners included within the dashed line circles of FIG. 1, again on a magnified scale, as in FIG. 2, showing an alternative embodiment of the invention.
Figure 9:
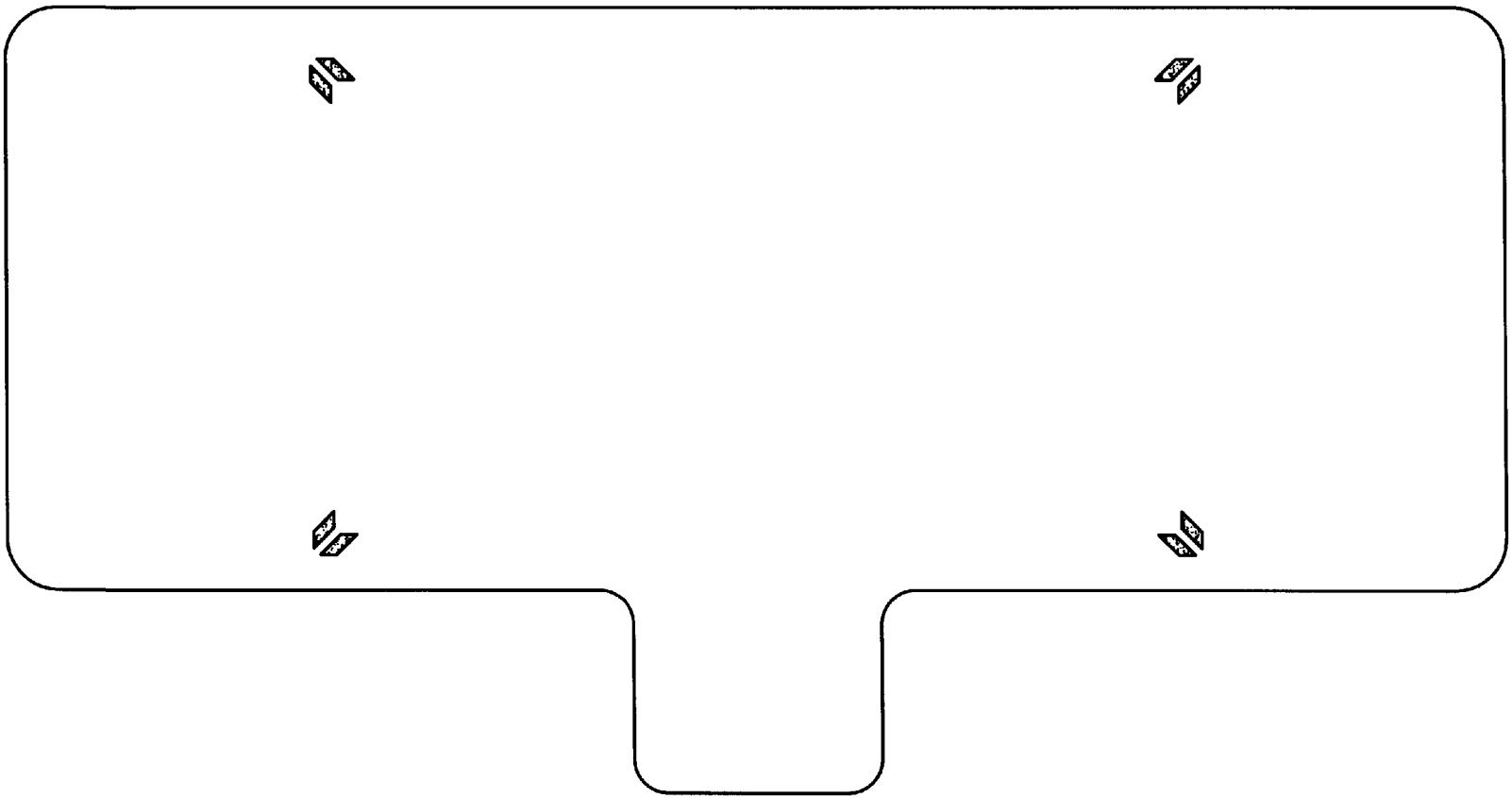
FIG. 9 is a view similar to FIG. 3 showing the markers formed by the alternative embodiment of FIG. 8, on the same reduced scale of FIG. 1.

FIGS. 8 and 9 portray an alternative embodiment of this invention. In particular, FIG. 8 shows on a magnified scale, the even more inwardly located inboard corners of the digital minute elements 14, 18 which are enclosed within the dashed line circles of FIG. 1. These corners are also severed and separated in the manner described for FIG. 2. However, whereas the severed corners of FIG. 2 result in the inclined double dash markers of FIG. 3 having sequences of alternate negative (slanting down from left to right) and positive (slanting up from left to right) slopes during the respective four quarter hours, the opposite sequence of positive-negative-positive-negative slopes are formed in FIGS. 8 and 9 due to the correspondingly opposite orientations of the corners respectively circled in the solid and dashed lines of FIG. 1. The end result is that the alternative markers of FIG. 9 create a spot lighting or highlighting effect to the central area of the display, in contrast to the surrounding or rotationally sweeping sense of motion generated by the markers of FIG. 3 around the center of the display.

Figure 10:
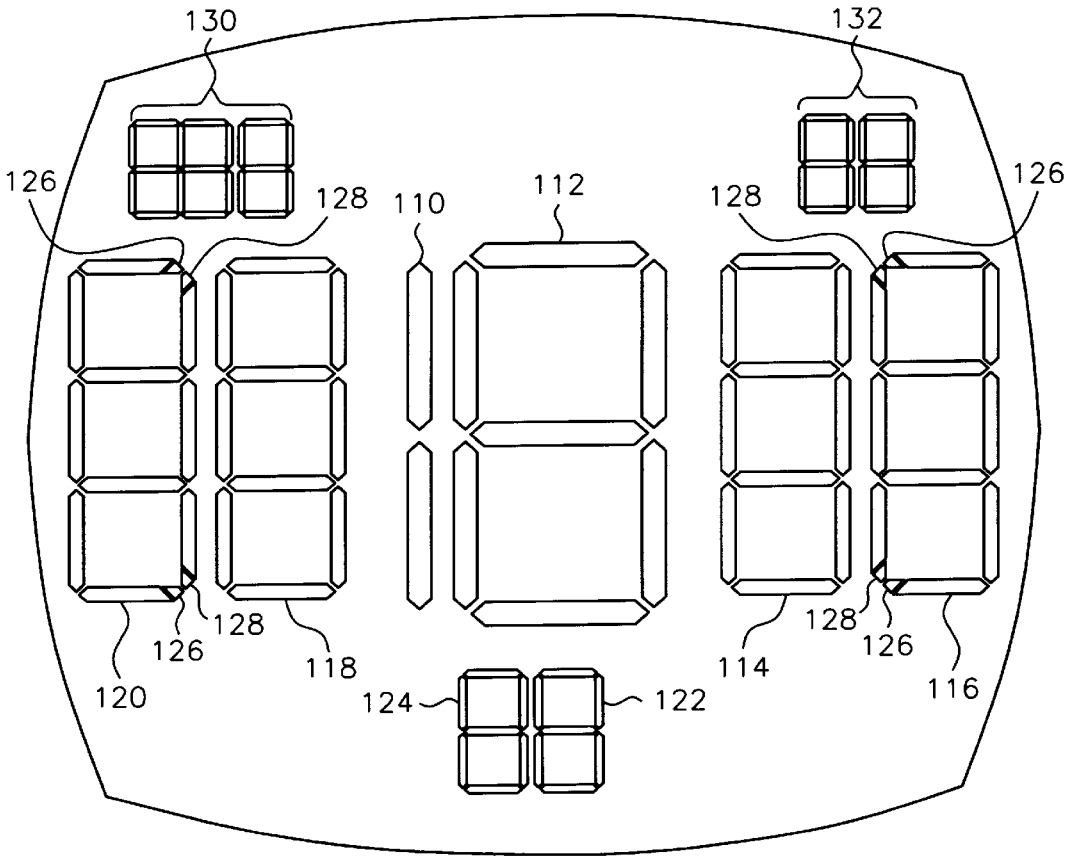
FIG. 10 is a view similar to FIG. 1 showing another embodiment of the invention.
Figure 11D:
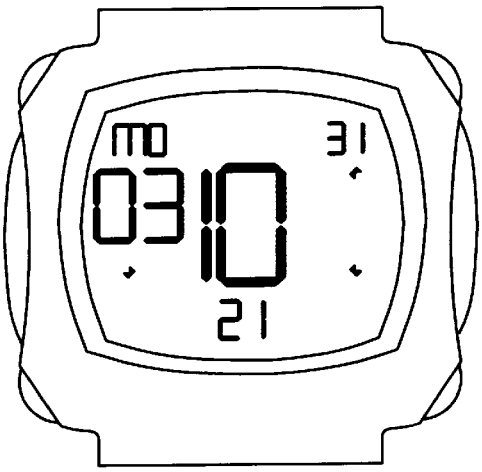
FIGS. 11A–11D are views of representative quarter hour time displays presented to the viewer with the embodiment of FIG. 10.
Figure 11A:
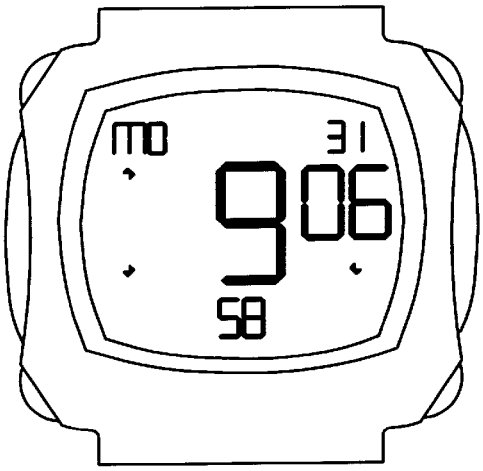
Figure 11C:
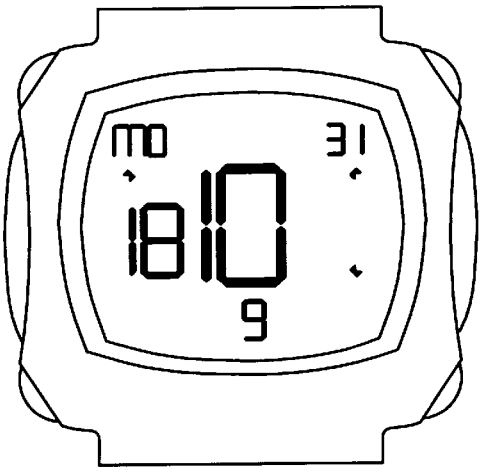
Figure 11B:
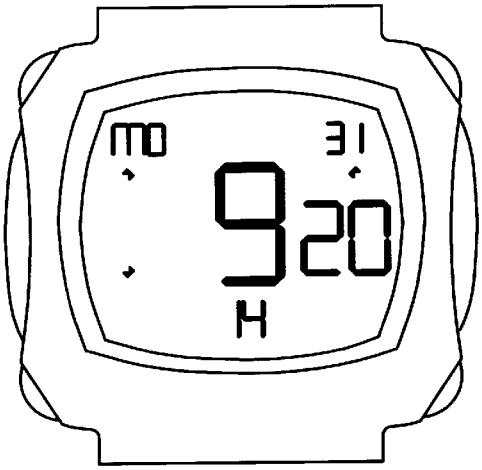
Figure 12D:
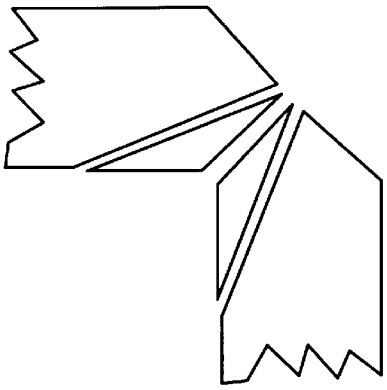
FIGS. 12A–12D are views of another embodiment of the invention.
Figure 12A:
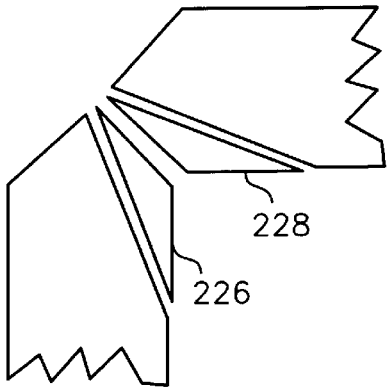
Figure 12C:
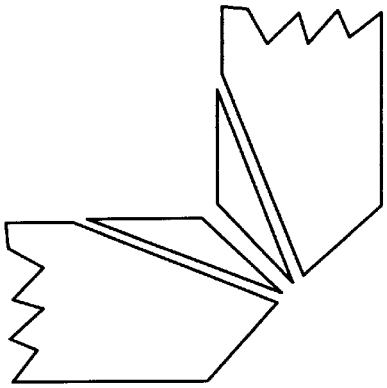
Figure 12B:
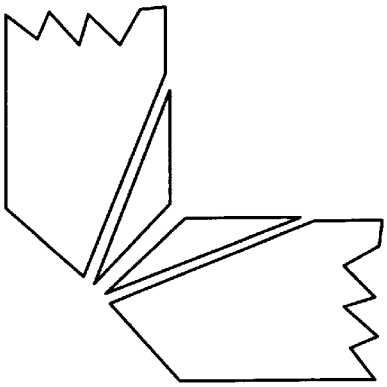

Another preferred embodiment of digital display elements for practicing this invention is illustrated in FIG. 10 which includes all of the display elements of FIG. 1 in a modified form. Therefore, corresponding elements in FIG. 10 have been given the same reference numerals as in FIG. 1, preceded with a 100 prefix, e.g., element 10 in FIG. 1 is referenced as 110 in FIG. 10, and so forth. In addition, FIG. 10 includes display elements 130 which are useful for displaying abbreviated first-two-letter names of the days of each week. The additional elements 132 are also included for displaying the dates of the days of each month.

A principal difference between FIGS. 1 and 10 is that all of the display elements of the latter have sharp pointed ends, shaped substantially as symmetrical arrowheads or spear points, with enclosed angles of substantially 90°. These pointed ends are spaced and nested together as closely as possible, such that the spaces between them are aligned preferably at substantially 45° of inclination. As a result, all of the time values displayed by the elements 110–124 of FIG. 10 gain enhanced symmetry of sizes and shapes. In addition, the severed inboard corners of elements 116 and 120 in FIG. 10 (markers 126, 128), analogous to those shown within solid circles in FIG. 1, have a different shape than the corresponding corner elements 26, 28 in FIG. 2. The latter comprise four pairs of markers, each element of which is shaped substantially as a parallelogram with two pairs of parallel opposite sides. In FIG. 10, the analogous markers comprise element pairs each of which is trapezoidal in shape with only one pair of parallel opposite sides.

As a result, each of the FIG. 10 markers extends toward the quarter hour space it marks with diverging slanted edges at its near ends and with squared off straight edges at its opposite far ends. This creates a distinctive shape that expands and enlarges toward the empty quarter hour space and at the same time closes off the space with an opposite straight-edged boundary that marks the uppermost or lowermost extent of the space. This contrasts from the sharp points that define the near and far ends of the markers of FIG. 1 due to the fact that they are shaped as pairs of parallelograms that lack squared off, right angled corners as in FIG. 10.

FIGS. 11A–11D illustrate representative time/day/date displays obtained during respective first through fourth quarter hours by activation of the corresponding elements of FIG. 10. The differences in the symmetries of element sizes and shapes, as well as the different shapes of these markers, can be seen by comparison with the representative displays of FIGS. 4–7 derived from FIG. 1.

FIGS. 12A–12D illustrate a variation of markers derived from FIG. 10 which provides a more stylized and streamlined sequence of quarter hour markers 226, 228 compared to FIGS. 11A–11D. In FIGS. 12A–12D only the analogous inboard severed corners of the FIG. 10 minute elements that generate such markers are shown on a somewhat enlarged scale to facilitate comprehension. As can be seen, the second sets of severance lines in each of these pairs extend from the sharp points at the ends of the elements, at an acute angle across each element until the inner horizontal and vertical edges thereof are reached and severed. Therefore, the resulting triangular sections of these ends of the minute elements can be separately activated to generate quarter hour markers having the shapes shown in FIGS. 13A–13D. Like the markers in FIGS. 11A–11D, the markers in FIGS. 13A–13D point toward the minute positions being marked with diverging inner edges at their relatively near ends, but extend back to sharp points at their opposite relatively far ends. Such shapes more closely resemble the shapes of the digital minutes displayed during the respective quarter hours and therefore may be more preferred as reminiscent markers which inform the viewer that such marked positions will be used to tell time at the appropriate intervals of each hour.

The marker shapes illustrated in FIGS. 13A–13D are based on second severance lines oriented at angles and having lengths which create markers shaped substantially as isosceles triangles. However, other angles, lengths and orientations of such severance lines can obviously be adopted to create generally analogous but specifically different shapes and sizes of such markers.

Figure 13D:
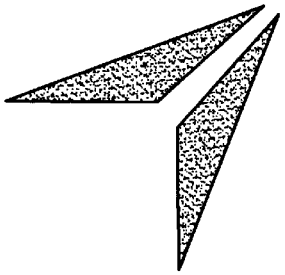
FIGS. 13A–13D are views of quarter hour markers that are presented to the viewer with the embodiment of FIGS. 12A–12D.
Figure 13A:
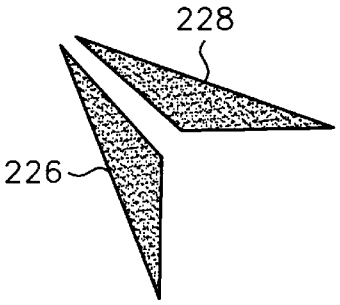
Figure 13C:
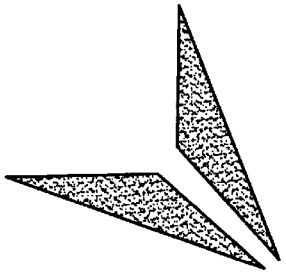
Figure 13B:
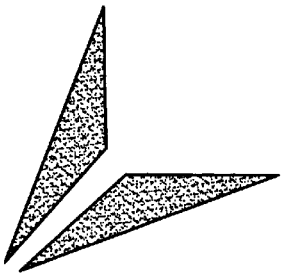

Moreover, the marker shapes in FIGS. 13A–13D, having an overall appearance of arrowheads, create symbolic suggestions that enhance the graphic effects produced by such markers. In particular, during the first half hour, the midpoint of such period is in between the first and second quarter hours. FIGS. 13A and 13B correspondingly display divergence and convergence of the backs of the arrowheads, angled to open toward and close away from quarter hour positions, thus symbolizing expansion and contraction of these respective quarter hour intervals. Also, the second marker, FIG. 13B, points toward the direction that the remaining third and fourth quarter hours will be displayed.

Similarly, the markers of FIGS. 13C and 13D provide analogous advantages. The backs of these markers also diverge and converge in angled positions toward and away from both quarter hour positions to symbolize expansion and contraction of these time periods. Also, the FIG. 13D marker points toward the top of the fourth, i.e. last, quarter hour position, which symbolizes the approaching end of the present hour and the simultaneous commencement of the displayed next hour.

Accordingly, the markers of FIGS. 13A–13D, when incorporated in quadribalanced time displays, e.g. as illustrated representatively in FIGS. 11A–11D, provide an optimum time display protocol in which the progress of each quarter hour is visually differentiated from the others and the exact time within each is instantly digitally defined, with complete visual and numerical balance between both the halves and the quarters of every hour.

The above-described alternative embodiments demonstrate that many other choices can be made to form design markers of various shapes that may be more or less appealing to the preferences of different viewers. Use of conventional dot matrix display elements or other high resolution elements in embodying the teachings of this invention will enable the markers to be configured in the shapes of one or more dots, dashes, asterisks, stars, arrowheads, ramps, triangles, squares, rectangles or other symbols that will perform the functions described for the exemplary embodiments discussed above.

It will be appreciated that, preferably, the spaces between the elements 26, 28, 126 and 128, including the corresponding spaces in FIGS. 12A–12D, and their respective horizontal and vertical elements, in all cases, should be as narrow as possible to enable separate electronic energizing of these elements while maintaining their closest feasible visual continuity.

Also, while in the preferred embodiment all four quarter hour areas are simultaneously activated with the current time and the three non-time-telling markers throughout the entire hour, other sequences can be used. For example, the quarter hour showing the current time can be accompanied by one marker in either the next or previous quarter hour space, or by a pair of markers in both the next and previous quarter hour spaces.

The use of smaller sized digital zeros with representative digital unit minutes is shown in FIGS. 4 and 7 of this application. Further details on the implementation and advantages of such displays during the first and last nine minutes of each hour are described in U.S. Pat. No. 5,805,534, the disclosure of which is incorporated herein by reference. Also, the uppermost six horizontal elements of the 10-segmented display elements 18, 20 in FIG. 1 of this application can be flashed during the last minute of each hour in the manner described in U.S. Pat. No. 5,757,730, the disclosure of which is also incorporated herein by reference. Furthermore, during the interval from the thirtieth to thirty-first minutes, preferably an initial digital minute of value 30 together with digital seconds of values 0 to 30 are displayed during the first half of the interval, followed by a digital minute of value 29 together with digital seconds of values 29 to 0 during the second half of the interval, as taught in U.S. Pat. No. 4,627,737, the disclosure of which is incorporated by reference.

In conclusion, the present invention has been described above in terms of its general principles and specific embodiments. Many variations of such disclosure will be obvious to those skilled in the art. Accordingly, it should be understood that the ensuing claims are intended to cover all changes and modifications of the specific illustrative embodiments which fall within the literal scope of the claims and all equivalents thereof.

The following is claimed:

1. In a quadribalanced time display in which a digital present hour is flanked on the right by increasing digital minutes in relatively upper and lower positions during the first and second quarter hours, and a digital next hour is flanked on the left by decreasing digital minutes in relatively lower and upper positions during the third and fourth quarter hours, the improvement comprising a marker provided in at least one of the three minute positions not occupied by digital minutes at any one time, said marker being included to inform the viewer that the marked position is a functional element of the display but not activated due to the current time being defined by digital minutes displayed in another of said minute positions at that time.

2. The improvement according to claim 1 wherein increasing digital minutes defining the current time are displayed in the relatively upper position flanking a digital present hour on the right during the first quarter hour, and at least the next relatively lower position normally used to display increasing digital minutes during the second quarter hour is simultaneously provided with said marker.

3. The improvement according to claim 1 wherein increasing digital minutes defining the current time are displayed in the relatively lower position flanking a digital present hour on the right during the second quarter hour, and at least the next relatively lower position normally used to display decreasing digital minutes during the third quarter hour is simultaneously provided with said marker.

4. The improvement according to claim 3 wherein the relatively upper position normally used to display increasing digital minutes during the first quarter hour is simultaneously provided with said marker.

5. The improvement according to claim 1 wherein decreasing digital minutes defining the current time are displayed in the relatively lower position flanking a digital next hour on the left during the third quarter hour, and at least the next relatively upper position normally used to display decreasing digital minutes during the fourth quarter hour is simultaneously provided with said marker.

6. The improvement according to claim 5 wherein the relatively lower position normally used to display increasing digital minutes during the second quarter hour is simultaneously provided with said marker.

7. The improvement according to claim 1 wherein the values of digital minutes displayed during the four quarter hours are 00 to 15 during the first quarter hour, 16 to 30 during the second quarter hour, 29 to 16 during the third quarter hour and 15 to 01 during the fourth quarter hour.

8. The improvement according to claim 7 wherein digital seconds are simultaneously displayed in values of 0 to 59 during each minute of the first and second quarter hours and in values of 59 to 0 during each minute of the third and fourth quarter hours, said digital seconds display being located below the digital hours display.

9. The improvement according to claim 8 wherein during the interval from the thirtieth to thirty-first minute of an hour, an initial digital minute of value 30 together with digital seconds of values 0 to 30 are displayed during the first half of said interval, and thereafter a digital minute of value 29 together with digital seconds of values 29 to 0 are displayed during the second half of said interval.

10. The improvement according to claim 1 wherein during the course of an hour as digital minutes defining the current time are displayed in each of the four positions representing the four quarter hours, the other three positions not displaying digital minutes are simultaneously provided with said markers.

11. The improvement according to claim 7 wherein during the interval of 1 to 9 increasing minutes, each such minute is preceded by a zero seconds digit, and during the interval of 9 to 1 decreasing minutes each such minute is preceded by a zero seconds digit.

12. The improvement according to claim 11 wherein during the interval of 1 to 9 increasing minutes, each zero digit is of smaller size than the minute digits and is located in a lower position relative to the height of the minute digits, and during the interval of 9 to 1 decreasing minutes, each zero digit is of smaller overall size than the minute digits and is located in an upper position relative to the height of the smaller minute digits.

13. The improvement according to claim 1 wherein said markers comprise paired segments of upper and lower corners of the horizontal and vertical display elements of the digital minutes, which paired segments, when activated, appear as inclined double dashes oriented in positions tending to surround centrally positioned digital hours in the display.

14. The improvement according to claim 1 wherein said markers comprise paired segments of upper and lower corners of the horizontal and vertical display elements of the digital minutes, which paired segments, when activated, appear as inclined double dashes oriented in positions tending to extend out from centrally positioned digital hours in the display.

15. The improvement according to claim 1 wherein each said marker comprises one or more dots, dashes, asterisks, stars, arrowheads, ramps, triangles, squares, rectangles or equivalent.

16. In a method of quadribalanced timekeeping by displaying increasing digital minutes in relatively upper and lower positions flanking a digital present hour on the right during the first and second quarter hours, and decreasing digital minutes in relatively lower and upper positions flanking a digital next hour on the left during the third and fourth quarter hours, the improvement comprising displaying a marker in at least one of the three minute positions not occupied by digital minutes at any one time, said marker being included to inform the viewer that the marked position is a functional element of the display but not activated due to the current time being defined by digital minutes displayed in another of said positions at that time.

17. The improvement according to claim 16 which further includes the steps of displaying increasing digital minutes in the relatively upper position flanking a digital present hour on the right during the first quarter hour and simultaneously marking at least the next relatively lower position normally used to display increasing digital minutes during the second quarter hour.

18. The improvement according to claim 16 which further includes the steps of displaying increasing digital minutes in the relatively lower position flanking a digital present hour on the right during the second quarter hour and simultaneously marking at least the next relatively lower position normally used to display decreasing digital minutes during the third quarter hour.

19. The improvement according to claim 18 which further includes the step of simultaneously marking the relatively upper position normally used to display increasing digital minutes during the first quarter hour.

20. The improvement according to claim 16 which further includes the steps of displaying decreasing digital minutes in the relatively lower position flanking a digital next hour on the left during the third quarter hour and simultaneously marking at least the next relatively upper position normally used to display decreasing digital minutes during the fourth quarter hour.

21. The improvement according to claim 20 which further includes the step of simultaneously marking the relatively lower position normally used to display increasing digital minutes during the second quarter hour.

22. The improvement according to claim 16 which further includes the steps of displaying digital minutes during the four quarter hours having the values of 00 to 15 during the first quarter hour, 16 to 30 during the second quarter hour, 29 to 16 during the third quarter and 15 to 01 during the fourth quarter hour.

23. The improvement according to claim 22 which further includes the steps of simultaneously displaying digital seconds having values 0 to 59 during each minute of the first and second quarter hours and values of 59 to 0 during each minute of the third and fourth quarter hours.

24. The improvement according to claim 23 which further includes the steps of displaying a digital minute of value 30 with digital seconds of values 0 to 30 during the first half of the interval from the thirtieth to thirty-first minute of an hour, and thereafter displaying a digital minute of value 29 with digital seconds of values 29 to 0 during the second half of said interval.

25. The improvement according to claim 16 which further includes the steps of displaying digital minutes defining the current time in each of the four positions representing the four quarter hours and simultaneously marking the other three positions not displaying digital minutes.

26. The improvement according to claim 22 which further includes the steps of displaying in front of increasing digital minutes having values 1 to 9 a zero digit, and of displaying in front of decreasing digital minutes having values 9 to 1 a zero digit.

27. The improvement according to claim 26 which further includes the steps of maintaining during the interval of 1 to 9 increasing minutes a zero digit of smaller overall size than the minute digits in a lower position relative to the height of the minute digits, and maintaining during the interval of 9 to 1 decreasing minutes a zero digit of smaller overall size than the minute digits in an upper position relative to the height of the minute digits.

28. The improvement according to claim 16, which further includes the steps of configuring each said marker in the shapes of one or more dots, dashes, asterisks, stars, arrowheads, ramps, triangles, squares, rectangles or equivalent.

29. In an enhanced quadribalanced time display in which digital present and next hours are displayed by centrally positioned display elements activatable to display unit hours and tens of hours with respective arrays of seven display elements for unit hours and one more display element for tens of hours, and in which increasing units and tens of minutes are displayed flanking present digital hours on the right in a relatively upper position during the first quarter hour and in a relatively lower position during the second quarter hour, and in which decreasing tens and units of minutes are displayed flanking next digital hours on the left in a relatively lower position during the third quarter hour and in a relatively upper position during the fourth quarter hour, by activatable pairs of display element arrays flanking the right and left sides of the centrally positioned hour display elements, each array comprising ten display elements, the improvement comprising providing each hour and minute display element with markers which are separate from the display elements, said markers having sharp, pointed ends.

30. The improvement according to claim 29 wherein the sharp pointed ends of said markers are spaced together as closely as possible to enhance symmetries of size and shape of the respectively displayed hours and minutes.

31. The improvement according to claim 29 further comprising a marker provided in at least one of the three minute positions not occupied by digital minutes at any one time, said marker being included to inform the viewer that the marked position is a functional element of the display but not activated due to the current time being defined by digital minutes displayed in another of said minute positions at that time.

32. The improvement according to claim 30 wherein said markers comprise a pair of segments of upper and lower corners of the horizontal and vertical display elements of the digital minutes which segments, when activated, appear as inclined double dashes.

33. The improvement according to claim 32 wherein each of said double dashes is shaped substantially as a parallelogram marker with two pairs of parallel sides.

34. The improvement according to claim 32 wherein each of said double dashes is shaped substantially as a trapezoidal marker with two parallel sides.

35. The improvement according to claim 34 wherein said trapezoidally shaped markers are positioned such that non-parallel edges thereof diverge in a direction extending toward and relatively near the minute position being marked, and opposite square cornered edges thereof relatively farther from the minute position being marked provide a straight line boundary to such position.

36. The improvement according to claim 34 wherein the parallel sides of said trapezoidally shaped markers are positioned parallel with each other at an inclination of substantially 45°.

37. The improvement according to claim 34 wherein during the course of an hour as digital minutes defining the current time are displayed in each of the four positions representing the four quarter hours, the other three positions not displaying digital minutes are simultaneously provided with said trapezoidally shaped markers.

38. The improvement according to claim 32 wherein each of said double dashes is shaped substantially as a triangular marker of generally isoceles form.

39. The improvement according to claim 38 wherein during the course of an hour as digital minutes defining the current time are displayed in each of the four positions representing the four quarter hours, the other three positions not displaying digital minutes are simultaneously provided with said triangularly shaped markers.

40. In an enhanced quadribalanced time display in which digital present and next hours are displayed by centrally positioned display elements activatable to display unit hours and tens of hours with respective arrays of seven display elements for unit hours and one more display element for tens of hours, and in which increasing units and tens of minutes are displayed flanking present digital hours on the right in a relatively upper position during the first quarter hour and in a relatively lower position during the second quarter hour, and in which decreasing tens and units of minutes are displayed flanking next digital hours on the left in a relatively lower position during the third quarter hour and in a relatively upper position during the fourth quarter hour, by activatable pairs of display element arrays flanking the right and left sides of the centrally positioned hour display elements, each array comprising ten display elements, the improvement comprising selected segments of adjacent elements of the minute display elements in the upper and lower quarter hour positions being severed into separate segments to enable separately activating such segments when such positions are not occupied by displayed digital minutes, such activated segments providing markers to inform the viewer that the marked position is a functional element of the display but not activated due to the current time being defined by digital minutes in another of said positions at that time.

* * * * *